US008967386B2

(12) United States Patent
Zhang et al.

(10) Patent No.: US 8,967,386 B2
(45) Date of Patent: Mar. 3, 2015

(54) MODULARIZED MAGNET SEPARATION UNIT

(75) Inventors: Chengchen Zhang, Fushun (CN); Qi Tang, Fushun (CN); Hengsheng Li, Fushun (CN); Chaopeng Li, Fushun (CN)

(73) Assignee: Safe Parking Limited, Katy, TX (US)

( * ) Notice: Subject to any disclaimer, the term of this patent is extended or adjusted under 35 U.S.C. 154(b) by 75 days.

(21) Appl. No.: 13/885,155

(22) PCT Filed: Nov. 22, 2011

(86) PCT No.: PCT/CN2011/082602

§ 371 (c)(1),
(2), (4) Date: May 13, 2013

(87) PCT Pub. No.: WO2012/151937

PCT Pub. Date: Nov. 15, 2012

(65) Prior Publication Data

US 2013/0233773 A1 Sep. 12, 2013

(30) Foreign Application Priority Data

May 9, 2011 (CN) ..... 2011 1 0117088

(51) Int. Cl.
*B03C 1/00* (2006.01)
*B03C 1/02* (2006.01)
(Continued)

(52) U.S. Cl.
CPC ..... *B03C 1/02* (2013.01); *B03C 1/0335* (2013.01); *B03C 1/08* (2013.01); *B03C 1/16* (2013.01); *B03C 2201/20* (2013.01)
USPC ..... 209/212; 209/213; 209/219; 209/221; 209/228; 209/231

(58) Field of Classification Search
CPC ..... B03C 1/23; B03C 1/247; B03C 2201/20; B03C 1/253; B03C 1/035; B03C 1/04; B03C 1/22; B03C 1/28; B03C 1/14; B03C 1/12; B03C 1/18; B03C 1/26; B03C 1/284; B03C 1/08; B03C 1/005; B03C 1/10; B03C 1/30; B03C 1/02; B03C 1/0375; B03C 1/16; B07B 1/005; B07B 9/00; B03B 13/04
USPC ..... 209/212, 213, 219, 221, 222, 225, 228, 209/231
See application file for complete search history.

(56) References Cited

U.S. PATENT DOCUMENTS 7,743,926 B2 * 6/2010 Lewis-Gray ..... 209/223.2
7,886,913 B1 * 2/2011 Fritz et al. ..... 209/224
(Continued)

FOREIGN PATENT DOCUMENTS

CN 2557233 Y 6/2003
CN 101214466 A 7/2008
(Continued)

*Primary Examiner* — David H Bollinger
(74) *Attorney, Agent, or Firm* — Andrew W. Chu; Craft Chu PLLC

(57) ABSTRACT

A modular magnetic separation apparatus set has a processing capacity increased by increasing the number of the unit modules of the magnetic separation apparatus set, being suitable for all enrichment processes of magnetic minerals. One modular unit is defined with a separation wheel and its two neighboring magnet-concentration cores and two corresponding excitation coils and a charging hopper and a discharging hopper of magnetic materials, each unit being combined of multiple identical modular units. The modular magnetic separation apparatus solves the conflicts between the transportation of apparatus after the enlargement and the height and width restrictions on general roads, including more reasonable conditions for separate transportation.

10 Claims, 3 Drawing Sheets

(51) Int. Cl.

| | |
|---|---|
| ***B03C 1/033*** | (2006.01) |
| ***B03C 1/08*** | (2006.01) |
| ***B03C 1/16*** | (2006.01) |

(56) References Cited

U.S. PATENT DOCUMENTS

| | | | | |
|---|---|---|---|---|
| 8,196,751 | B2 * | 6/2012 | Shuttleworth et al. | 209/215 |
| 8,561,807 | B2 * | 10/2013 | Ross | 209/636 |
| 8,562,829 | B2 * | 10/2013 | Isogami et al. | 210/222 |
| 2003/0183580 | A1 | 10/2003 | Schaaf | |

FOREIGN PATENT DOCUMENTS

| | | | |
|---|---|---|---|
| CN | 201179479 | Y | 1/2009 |
| CN | 201275499 | Y | 7/2009 |
| CN | 101786041 | A | 7/2010 |
| CN | 102205272 | A | 10/2011 |
| JP | 1024248 | A | 1/1998 |

* cited by examiner

MODULARIZED MAGNET SEPARATION UNIT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention pertains to a magnetic separation apparatus, specifically to a modular magnetic separation apparatus set of brand new type, and this invention is particularly suitable for the magnetic separation in the enrichment section of weak magnetic minerals.

2. Description of Related Art Including Information Disclosed Under 37 CFR 1.97 and 37 CFR 1.98

Along with the continually economic development in China in recent years, there has been a large increase in the demand for refined minerals such as iron minerals, manganese minerals, titanium minerals, etc., and then the apparatus and methods for mineral separation that are suitable for metal mineral separation have been rapidly developed. Among these, the apparatus for mineral separation of the strong magnetic type has gained massive and general applications, apparatus of the general strong magnetic type currently in China being single and individual apparatus; the method for enhancing the processing capacity in extensive exploitation of mining being either to enlarge the model or to increase the number of apparatus.

As the large scale and unscientifically continuous exploitation and the minerals resources limitation, as a result, the strong magnetic mineral resources that are easy to separate has become less and less. In order to separate the desired materials from weak magnetic mineral resources that are difficult to magnetically separate, in accordance with the current performance of apparatus, it is a must to conduct the separation using apparatus of the strong magnetic type. In addition, with the enlarging scale of separation plants, it has become the mainstream to choose large scale apparatus. To enhance the processing capacity of separation plants, it is necessary to enlarge the model or increase the number of apparatus. Even so, it has never been able to meet the requirement in processing capacity of 300 tons of dry minerals or above per hour per apparatus using current magnetic separation apparatus.

In addition, the largest standard and model of strong magnetic separation apparatus in the prior art has reached the critical value limited by general road transportation conditions, and moreover, such a practice of limitless enlargement in the standard and model cannot be achieved with the constraints of processing apparatus. In a separation plant area with a fixed scale of production, it would be the only way to increase the number of selected apparatus if the output capacity were to be enhanced; while in a large separation plant, more maintenance and management cost, together with one more malfunction point, would occur if one apparatus were to be added. Therefore, increasing the number of apparatus in use is not beneficial for the unified management of a large scale separation plant, thus the magnetic separation apparatus in the prior art having become less and less suitable for large scale separation plants. The limitation is particularly apparent for the separation of weak magnetic mineral resources.

Therefore, there is an urgent demand for a magnetic separation apparatus that is suitable for the separation of weak magnetic mineral resources and that has a large processing capacity also.

SUMMARY OF THE INVENTION

To overcome the drawbacks in the prior art, a modular magnetic separation apparatus set is provided through times of design and research by technical staffs, which is a magnetic separation apparatus that is suitable for the separation of weak magnetic mineral resources and that has a large processing capacity. Through redesign of the structure of the magnetic separation apparatus, the magnetic separation apparatus in this invention has been made a brand new magnetic separation apparatus, which is not only suitable for the separation of weak magnetic mineral resources, but also is able to enhance the separation effect by rationally arranging magnetic components, enhancing the processing capacity through increasing the modular unit number of the set.

According to the technical scheme of the invention, a brand new modular magnetic separation apparatus set is provided, the processing capacity of the magnetic separation apparatus being enhanced by increasing the modular unit number of the magnetic separation apparatus set, being suitable for the separation and enrichment processing of weak magnetic mineral of any processing capacity required.

The modular magnetic separation apparatus set includes excitation coils, magnet-concentration cores, separation wheels, a magnetic materials collecting hopper, a non-magnetic material discharging hopper, a material oscillator, a wheel water-washing device, a support, a wheel driving device, a material flow separation duct, a magnetic material gathering hopper and a charging hopper; wherein the excitation coils revolve around the outside of magnet-concentration cores, the separation wheels being located between the two pole heads of the magnet-concentration cores, the magnetic materials collecting hopper being located between the magnetic separation wheels and the excitation coils, the non-magnetic material discharging hopper being located under the magnetic separation wheels and the magnet-concentration cores, the material oscillator being located on one side of the non-magnetic material discharging hopper, the wheel water-washing device being located on top of the magnetic separation wheels, the magnetic separation wheels being connected with the wheel driving device and fixed on one side of the magnet-concentration cores, and the material flow separation duct is installed at the mineral materials charging position, mineral materials flowing into the charging hopper via the material flow separation duct that is located on top of the magnet-concentration cores on the inner side of the magnetic separation wheels, the magnetic materials that flow out of the magnetic materials collecting hopper being gathered in the magnetic material gathering hopper 11; the described modular magnetic separation apparatus set being supported by the support 8.

Preferably, the magnet-concentration cores 2 on the inner side the excitation coils 1 are placed horizontally; when the excitation coils 1 are conducting, the magnet-concentration cores 2 generating background magnetic field in a horizontal direction under the excitation of the excitation coils 1, the direction of the background magnetic field being the same as the direction of laying the magnet-concentration cores 2.

Preferably, the separation wheels 3 are installed vertically between the two pole heads of the magnet-concentration cores, the separation wheels being equipped with magnetic field concentration boards with sharp teeth.

Preferably, pasty materials are oscillated in an up-and-down direction at the position of the separation wheels 3 in the separation area with the effect of the material oscillator 6.

More preferably, one effusion board is installed in the charging hopper 12, which enables minerals to be evenly fed to the separation wheels 3 when the materials flow out of the charging hopper 12.

More preferably, magnetic materials may be absorbed onto the tips of the sharp teeth of the magnetic field concentration boards of the separation wheels 3 when flowing across the separation area, then rotating out of the separation area between the two magnet-concentration cores 2 following the separation wheels 3, and rotate to the position of the wheel water-washing device 7.

Further, magnetic materials rotate to the top of the set following the rotating wheel, after being washed by the minerals unloading water sprayed by the water-washing device 7 on the top, all the magnetic materials which have been separated flowing into the magnetic materials collecting hopper 4, and then being gathered into the magnetic material gathering hopper 11.

More preferably, all the non-magnetic materials are not absorbed when passing through the magnetic field concentration boards of the separation wheels 3, being discharged from the modular magnetic separation apparatus set after flowing into the non-magnetic material discharging hopper 5 through directly flowing across the separation wheels 3.

Furthermore preferably, one modular unit is defined with a separation wheel 3, its two neighboring pole heads of the magnetic concentrating cores 2 and two corresponding excitation coils 1 and the magnetic materials collecting hopper 4 and the charging hopper 12, each magnetic separation apparatus set being a combination of multiple identical modular units, multiple separation wheels 3 of the multiple modular units being connected via a shaft, the non-magnetic material discharging hopper 5 being shared, and the materials to be separated being oscillated by a common material oscillator 6. Among these, the magnet-concentration cores between the neighboring separation wheels 3 and two corresponding excitation coils 1, and the magnetic materials collecting hopper 4 and the charging hopper 12 are shared or not shared.

Using the technical scheme in the invention, the overall structure of the general strong magnetic separation apparatus is substantially changed, not only solving the bottle-neck problem of enlargement of existing apparatus, but also solving the conflicts between the transportation of apparatus after the enlargement and the height and width restrictions on general roads, and a single apparatus might be enlarged limitlessly by way of adding the number of module units of the set, at the same time also enhancing the processing capacity on a year growth, and the apparatus are provided with more reasonable conditions for separate transportation.

BRIEF DESCRIPTION OF THE DRAWINGS

In FIGS. 1-3, the parts indicated respectively by each reference of the drawings are as follows:

1: excitation coils, 2: magnet-concentration cores, 3: separation wheels, 4: magnetic materials collecting hopper, 5: non-magnetic material discharging hopper, 6: material oscillator, 7: wheel water-washing device, 8: support, 9: wheel driving device, 10: material flow separation duct, 11: magnetic material gathering hopper, and 12: charging hopper.

DETAILED DESCRIPTION OF THE DRAWINGS

The modular magnetic separation apparatus set in the invention is illustrated in detail below with reference to the drawings. The illustration is only by way of example and the scope of the invention should not be limited to the specific structures of the modular magnetic separation apparatus set or specific parameters of parts.

Figure 1:
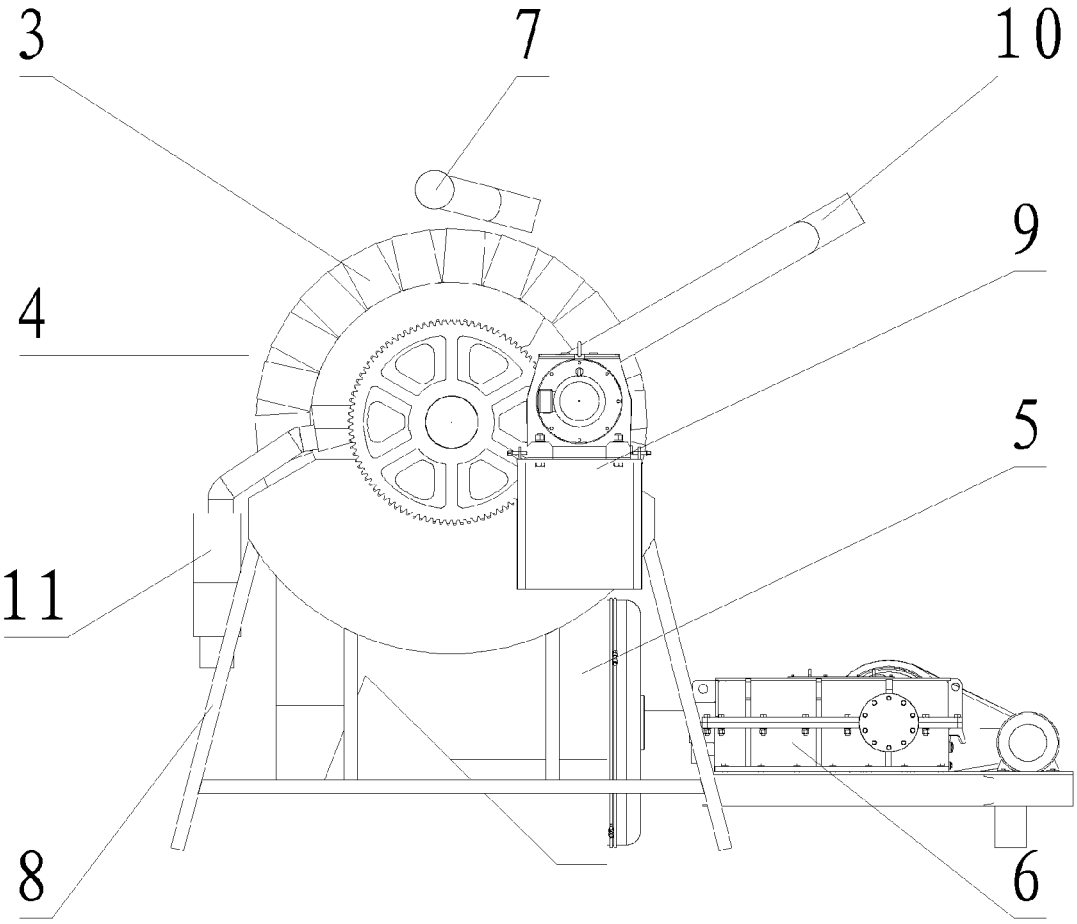
FIG. 1 is a side view of a modular magnetic separation apparatus set according to the invention.
Figure 2:
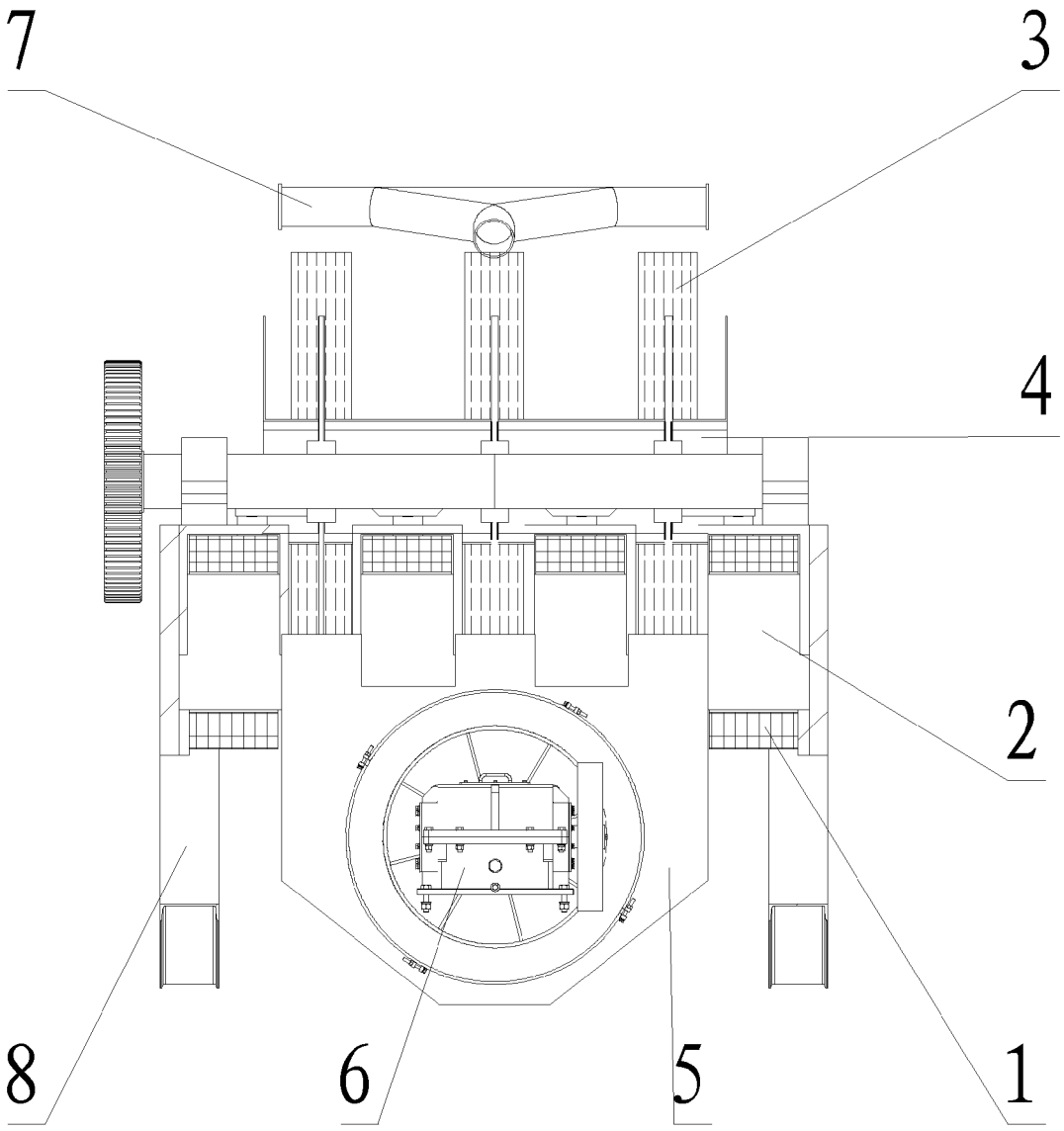
FIG. 2 is a sectional view of the magnet-concentration cores and the excitation coils in the main view of the modular for magnetic separation apparatus set.
Figure 3:
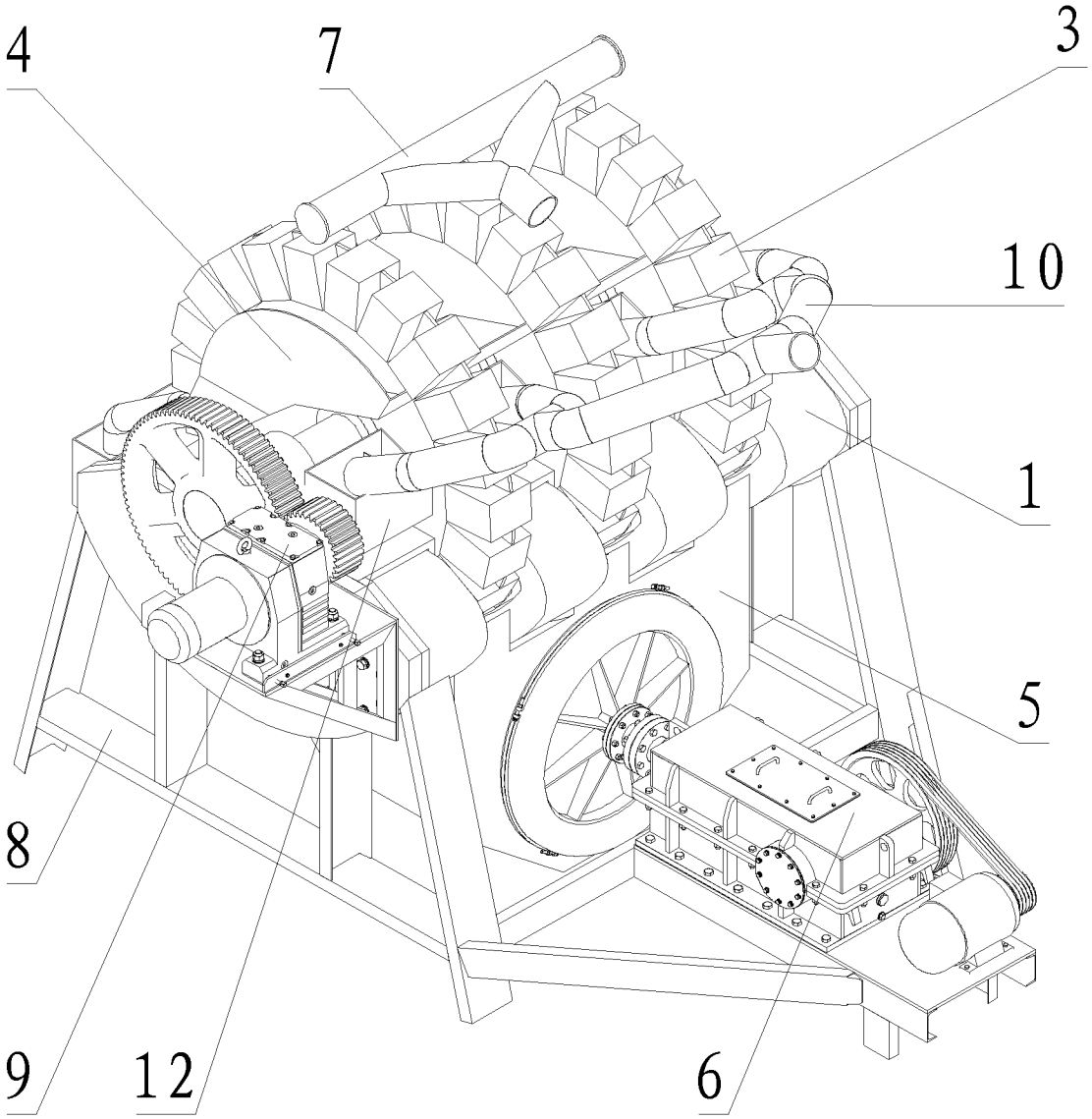
FIG. 3 is an axial view of the modular for magnetic separation apparatus set.

The modular magnetic separation apparatus set is suitable for the enrichment of weak magnetic minerals with reference to FIGS. 1-3, which includes excitation coils 1, magnet-concentration cores 2, separation wheels 3, a magnetic materials collecting hopper 4, a non-magnetic material discharging hopper 5, a material oscillator 6, a wheel water-washing device 7, a wheel driving device 9, a material flow separation duct 10, a magnetic material gathering hopper 11 and a charging hopper 12; wherein the excitation coils 1 revolve around the outside of magnet-concentration cores 2, the separation wheels 3 being located between the two pole heads of the magnet-concentration cores 2, the magnetic materials collecting hopper 4 being located between the magnetic separation wheels 3 and the excitation coils 1, the non-magnetic material discharging hopper 5 being located under the magnetic separation wheels 3 and the magnet-concentration cores 2, the material oscillator 6 being located on one side of the non-magnetic material discharging hopper 5, the wheel water-washing device 7 being located on top of the magnetic separation wheels 3, the magnetic separation wheels 3 being connected with the wheel driving device 9 and fixed on one side of the magnet-concentration cores 2, and the material flow separation duct 10 is installed at the mineral materials charging position, mineral materials flowing into the charging hopper 12 via the material flow separation duct 10 that is located on top of the magnet-concentration cores 2 on the inner side of the magnetic separation wheels 3, the magnetic materials that flow out of the magnetic materials collecting hopper 4 being gathered in the magnetic material gathering hopper 11; the described modular magnetic separation apparatus set being supported by the support 8.

A horizontal background magnetic field, whose direction is the same as the direction of laying the magnet-concentration cores 2, is generated by the magnet-concentration cores 2 under the excitation of the excitation coils 1 when the excitation coils 1 are powered on. The separation wheels 3 are installed vertically between the two pole heads of the magnet-concentration cores, the separation wheels being equipped with magnetic field concentration boards with sharp teeth. An oscillation in an up-and-down direction occurs to the pasty materials in the separation area with the effect of the material oscillator 6.

In addition, one overflow board is installed in the charging hopper 12, which enables the materials to be evenly fed to the separation wheels 3 when flowing out of the charging hopper 12. Magnetic materials may be absorbed onto the tips of the sharp teeth of the magnetic field concentration boards of the separation wheels 3 when flow across the separation area, then rotating out of the separation area between the two magnet-concentration cores 2 following the separation wheels 3, and rotate to the position of the wheel water-washing device 7.

Further, magnetic materials rotate to the top of the set following the rotating wheel, after being washed by the minerals unloading water sprayed by the water-washing device 7 on the top, all the magnetic materials which have been separated flowing into the magnetic materials collecting hopper 4, and then being gathered into the magnetic material gathering hopper 11. All the non-magnetic materials are not absorbed when passing through the magnetic field concentration boards of the separation wheels 3, being discharged from the modular magnetic separation apparatus set after flowing into the non-magnetic material discharging hopper 5 through directly flowing across the separation wheels 3

The way to modularly constitute the modular magnetic separation apparatus set is: One modular unit is defined with a separation wheel 3 and its two neighboring pole heads of the magnetic concentrating cores 2 and two corresponding excitation coils 1 and the magnetic materials collecting hopper 4 and the charging hopper 12, each magnetic separation apparatus set being a combination of multiple identical modular units, multiple separation wheels 3 of the multiple modular units being connected via a shaft, the non-magnetic material discharging hopper 5 being shared, and the materials to be separated being oscillated by a common material oscillator 6. Among these, the magnet-concentration cores between the neighboring separation wheels 3 and two corresponding excitation coils 1, and the magnetic materials collecting hopper 4 and the charging hopper 12 are shared or not shared.

In order to further illustrate the industrial applicability and beneficial effects of the modular magnetic separation apparatus set of the invention, the apparatus will be elaborated in detail referring below to the operation principles of the modular magnetic separation apparatus set:

The excitation coils 1 revolve around the outside of magnet-concentration cores 2, the magnet-concentration cores 2 being laid out horizontally, a horizontal background magnetic field, whose direction is the same as the direction of laying the magnet-concentration cores 2, being generated by the magnet-concentration cores 2 under the excitation of the excitation coils 1 when the excitation coils 1 are powered on, the magnetic area being the separation area of the materials, the direction of the magnetic field of the area being vertical to the direction into which the materials flow and which the materials oscillate. The separation wheels 3 are located between the two pole heads of the magnet-concentration cores, the separation wheels being equipped with magnetic field concentration boards with sharp teeth. An area with strong magnetic field in a small scale is generated at the tips of the sharp teeth of the magnetic field concentration boards on the separation wheels 3, and magnetic materials may be absorbed onto the tips of the sharp teeth of the magnetic field concentration boards of the separation wheels 3 with the effect of the magnetic field in the area. A material oscillator 6 is located on one side of the non-magnetic material discharging hopper 5, an oscillation in an up-and-down direction occurring to the pasty materials at the separation wheels 3 in the separation area with the effect of the material oscillator 6. The materials to be separated flow evenly into each charging hopper 12 after the flow separation by the material flow separation duct 10. One overflow board is installed in the charging hopper 12, which enables the materials be evenly fed to the separation wheels 3 when flowing out of the charging hopper 12, thereby achieving steady and good targets for separation.

The materials separation begins when the materials to be separated are evenly fed into the separation area behind the separation wheel 3 after flowing into the charging hopper 12 via overflow. The materials are absorbed onto the tips of the sharp teeth of the magnetic field concentration boards when the materials to be separated flow across the separation wheels 3 and since the direction of the magnetic field being horizontal, a material chain in a horizontal direction can thus be formed from the magnetic materials with the effect of the magnetic force, and the magnetic materials rotate together with the separation wheel 3, thus passing through the separation area.

An oscillation in an up-and-down direction occurs to the materials to be separated during the process of passing the separation area with the effect of the material oscillator 6; a wash being fully conducted to the magnetic materials that have been absorbed onto the tips of the sharp teeth on the magnetic field concentration boards under such a oscillation, thus reducing the mix of magnetic and non-magnetic materials, and also effectively preventing the blockage between the magnetic field concentration boards on the wheels.

Magnetic materials are absorbed onto the tips of the sharp teeth of the magnetic field concentration boards of the separation wheels 3, then rotating out of the separation area between the two magnet-concentration cores 2 following the separation wheels 3, and rotate to the position of the wheel water-washing device 7 on top of the apparatus. All the magnetic materials that are separated out flow into the magnetic materials collecting hopper 4 after being washed by the minerals unloading water sprayed from the wheel water-washing device 7, then being gathered into the magnetic material gathering hopper 11. All the non-magnetic materials are not absorbed when passing through the magnetic field concentration boards of the separation wheels 3, being discharged from the set after flowing into the non-magnetic material discharging hopper 5 through directly flowing across the separation wheels 3.

In conclusion, the magnetic separation apparatus set of the invention has been clearly described in detail. It could be appreciated by those that skilled in the art that various modifications to the format and details could be made without deviating from the spirit and the scope of the invention defined by the appended claims. In addition, the embodiments in the disclosure are for the purpose of elaboration and illustration of the technical schemes, and the scope should not be specifically limited to any of the specific embodiment in the invention.

We claim:

1. A modular magnetic separation apparatus, comprising:

a support having a first end and a second end;

excitation coils, being mounted on said support from said first end to said second end;

magnet-concentration cores, said excitation coils being rotatable around said magnet-concentration cores, each core having a pole head;

separation wheels, being positioned between pole heads of two magnet-concentration cores;

a magnetic materials collecting hopper, extending between said separation wheels and said excitation coils;

a non-magnetic material discharging hopper, being positioned under said separation wheels and said magnet-concentration cores, said non-magnetic material discharging hopper having a front side and a back side;

a material oscillator, being located on said front side of said non-magnetic material discharging hopper;

a wheel water-washing device, being positioned above said separation wheels;

a wheel driving device, connecting to said separation wheels and mounted on said first end of said support;

a material flow separation duct, being positioned above said magnet-concentration cores;

a magnetic material gathering hopper being positioned on said back side of said non-magnetic material discharging hopper, said magnetic material gathering hopper being connected to said magnetic materials collecting hopper; and a charging hopper, connecting said material flow separation duct to inner sides of said separation wheels, said material flow separation duct having a mineral materials charging position so as to flow mineral materials into said charging hopper.

2. The modular magnetic separation apparatus of claim 1, wherein said magnet-concentration cores are placed horizontally; and wherein said magnet-concentration cores generate a background magnetic field in a horizontal direction under excitation of said excitation coils, when said excitation coils conduct current, said background magnetic field having a direction identical to a direction of arrangement of said magnet-concentration cores.

3. The modular magnetic separation apparatus of claim 1, wherein said separation wheels are installed vertically between the two pole heads of the two magnet-concentration cores.

4. The modular magnetic separation apparatus of claim 1, wherein said material oscillator is cooperative with said separation wheels so as to oscillate materials upward toward and downward from said separation wheels through said non-magnetic material discharging hopper.

5. The modular magnetic separation apparatus of claim 1, wherein said charging hopper connects to said separation wheels.

6. The modular magnetic separation apparatus of claim 1, wherein said separation wheels have a separation area between two magnet-concentration cores while rotating, said separation wheels connecting to said wheel water-washing device while rotating so as to transfer material from said separation wheels to said wheel water-washing device.

7. The modular magnetic separation apparatus of claim 1, wherein said separation wheels connect to said magnetic materials collecting hopper, after connecting to said wheel water-washing device, so as to transfer material from said separation wheel to said magnetic materials collecting hopper, after washing and while rotating, and wherein said magnetic materials collecting hopper connects to said magnetic material gathering hopper so as to transfer material from said magnetic materials collecting hopper to said magnetic material gathering hopper.

8. The modular magnetic separation apparatus of claim 1, wherein said separation wheels have a separation area between two magnet-concentration cores while rotating, said separation wheels-connecting to said non-magnetic material discharging hopper while rotating so as to transfer non-magnetic materials from said separation wheels to said non-magnetic material discharging hopper.

9. The modular magnetic separation apparatus of claim 1, wherein one modular unit is defined with a single separation wheel, two magnetic concentrating cores on each side of said single separation wheel, each magnetic concentrating core having a pole head, two excitation coils placed around said two magnetic concentrating cores on each side of said single separation wheel, a single magnetic materials collecting hopper and a single charging hopper, each modular unit being interchangeable and identical, and wherein a shaft connects each separation wheel of each modular units, wherein said non-magnetic material discharging hopper connects to each modular unit, and wherein said material oscillator oscillates each modular unit.

10. The modular magnetic separation apparatus of claim 9, wherein a magnet-concentration core on one side of said single separation wheel connects to an adjacent separation wheel of another modular unit, wherein said single magnetic materials collecting hopper connects to said adjacent separation wheel of said another modular unit, and wherein said single charging hopper connects to said adjacent separation wheel of said another modular unit.

* * * * *

UNITED STATES PATENT AND TRADEMARK OFFICE

CERTIFICATE OF CORRECTION

PATENT NO. : 8,967,386 B2
APPLICATION NO. : 13/885155
DATED : March 3, 2015
INVENTOR(S) : Chengchen Zhang et al.

It is certified that error appears in the above-identified patent and that said Letters Patent is hereby corrected as shown below:

Title page, item 73, assignee

Please delete
"Safe Parking Limited, Katy, TX (US)".

Please substitute
"LONGI MAGNET Co., Ltd., Fushun City, Liaoning (CN)".

Signed and Sealed this
Third Day of November, 2015

Michelle K. Lee

Michelle K. Lee
*Director of the United States Patent and Trademark Office*